US006205995B1

(12) United States Patent
Odenwald

(10) Patent No.: US 6,205,995 B1
(45) Date of Patent: Mar. 27, 2001

(54) PORTABLE COOKING APPARATUS

(76) Inventor: Joseph A. Odenwald, N. 6372 Hwy. PS, Hartford, WI (US) 53027

( * ) Notice: Subject to any disclaimer, the term of this patent is extended or adjusted under 35 U.S.C. 154(b) by 0 days.

(21) Appl. No.: 09/552,832

(22) Filed: Apr. 20, 2000

(51) Int. Cl.[7] ..... F24C 5/20
(52) U.S. Cl. ..... 126/38; 126/25 R; 126/9 R; 99/425
(58) Field of Search ..... 126/38, 40, 9 R, 126/9 B, 41 R, 25 R, 29, 275 R; 99/400, 444, 446, 425

(56) References Cited

U.S. PATENT DOCUMENTS 3,651,796 * 3/1972 Nelson ..... 126/38
3,753,431 * 8/1973 Koziol ..... 126/38
3,890,952 * 6/1975 Hamre ..... 126/38
3,913,557 * 10/1975 Ewanika et al. ..... 99/446
4,426,990 * 1/1984 Shepherd ..... 126/9 B
4,681,083 * 7/1987 Shu ..... 126/38
5,553,601 * 9/1996 Parker et al. ..... 126/38

* cited by examiner

*Primary Examiner*—James C. Yeung
*Assistant Examiner*—Josiah C. Cocks

(57) ABSTRACT

A portable cooking apparatus for allowing the user to conveniently cook any types of foods anywhere including outdoors. The portable cooking apparatus includes includes a carrying case having a bottom wall, side walls, a back wall, an open front, and a cover having a back edge which is hingedly attached to the back wall and also having a latch member securely attached at a front edge thereof, and a handle member securely disposed at the open front and being adapted for carrying the carrying case; and also includes a griddle member being securely mounted inside the carrying case; and further includes a heating assembly for heating the griddle member to temperatures capable of cooking foods thereupon; and also includes a receptacle being removably mounted to a first one of the side walls of the carrying case for receiving juices and fats from the foods being cooked upon the griddle member; and also includes a plurality of adjustable leg members threaded in the bottom wall of the carrying case for supporting the carrying case upon a surface when the portable cooking apparatus is being used as such.

8 Claims, 2 Drawing Sheets

PORTABLE COOKING APPARATUS

BACKGROUND OF THE INVENTION

1. Field of the Invention

The present invention relates to a portable griddle and more particularly pertains to a new portable cooking apparatus for allowing the user to conveniently cook any types of foods anywhere including outdoors.

2. Description of the Prior Art

The use of a portable griddle is known in the prior art. More specifically, a portable griddle heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,791,368; 5,575,195; 4,321,857; 5,752,497; 3,490,433; and U.S. Pat. No. Des. 262,595.

While these devices fulfill their respective, particular objectives and requirements, the aforementioned patents do not disclose a new portable cooking apparatus. The inventive device includes a carrying case having a bottom wall, side walls, a back wall, an open front, and a cover having a back edge which is hingedly attached to the back wall and also having a latch member securely attached at a front edge thereof, and a handle member securely disposed at the open front and being adapted for carrying the carrying case; and also includes a griddle member being securely mounted inside the carrying case; and further includes a heating assembly for heating the griddle member to temperatures capable of cooking foods thereupon; and also includes a receptacle being removably mounted to a first one of the side walls of the carrying case for receiving juices and fats from the foods being cooked upon the griddle member; and also includes a plurality of adjustable leg members threaded in the bottom wall of the carrying case for supporting the carrying case upon a surface when the portable cooking apparatus is being used as such.

In these respects, the portable cooking apparatus according to the present invention substantially departs from the conventional concepts and designs of the prior art, and in so doing provides an apparatus primarily developed for the purpose of allowing the user to conveniently cook any types of foods anywhere including outdoors.

SUMMARY OF THE INVENTION

In view of the foregoing disadvantages inherent in the known types of portable griddle now present in the prior art, the present invention provides a new portable cooking apparatus construction wherein the same can be utilized for allowing the user to conveniently cook any types of foods anywhere including outdoors.

The general purpose of the present invention, which will be described subsequently in greater detail, is to provide a new portable cooking apparatus which has many of the advantages of the portable griddle mentioned heretofore and many novel features that result in a new portable cooking apparatus which is not anticipated, rendered obvious, suggested, or even implied by any of the prior art portable griddle, either alone or in any combination thereof.

To attain this, the present invention generally comprises includes a carrying case having a bottom wall, side walls, a back wall, an open front, and a cover having a back edge which is hingedly attached to the back wall and also having a latch member securely attached at a front edge thereof, and a handle member securely disposed at the open front and being adapted for carrying the carrying case; and also includes a griddle member being securely mounted inside the carrying case; and further includes a heating assembly for heating the griddle member to temperatures capable of cooking foods thereupon; and also includes a receptacle being removably mounted to a first one of the side walls of the carrying case for receiving juices and fats from the foods being cooked upon the griddle member; and also includes a plurality of adjustable leg members threaded in the bottom wall of the carrying case for supporting the carrying case upon a surface when the portable cooking apparatus is being used as such.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable cooking apparatus which has many of the advantages of the portable griddle mentioned heretofore and many novel features that result in a new portable cooking apparatus which is not anticipated, rendered obvious, suggested, or even implied by any of the prior art portable griddle, either alone or in any combination thereof.

It is another object of the present invention to provide a new portable cooking apparatus which may be easily and efficiently manufactured and marketed.

It is a further object of the present invention to provide a new portable cooking apparatus which is of a durable and reliable construction.

An even further object of the present invention is to provide a new portable cooking apparatus which is susceptible of a low cost of manufacture with regard to both materials and labor, and which accordingly is then susceptible of low prices of sale to the consuming public, thereby making such portable cooking apparatus economically available to the buying public.

Still yet another object of the present invention is to provide a new portable cooking apparatus which provides in the apparatuses and methods of the prior art some of the advantages thereof, while simultaneously overcoming some of the disadvantages normally associated therewith.

Still another object of the present invention is to provide a new portable cooking apparatus for allowing the user to conveniently cook any types of foods anywhere including outdoors.

Yet another object of the present invention is to provide a new portable cooking apparatus which includes includes a carrying case having a bottom wall, side walls, a back wall, an open front, and a cover having a back edge which is hingedly attached to the back wall and also having a latch member securely attached at a front edge thereof, and a handle member securely disposed at the open front and being adapted for carrying the carrying case; and also includes a griddle member being securely mounted inside the carrying case; and further includes a heating assembly for heating the griddle member to temperatures capable of cooking foods thereupon; and also includes a receptacle being removably mounted to a first one of the side walls of the carrying case for receiving juices and fats from the foods being cooked upon the griddle member; and also includes a plurality of adjustable leg members threaded in the bottom wall of the carrying case for supporting the carrying case upon a surface when the portable cooking apparatus is being used as such.

Still yet another object of the present invention is to provide a new portable cooking apparatus that is convenient and easy to carry and take almost anywhere thus allowing the user to essentially cook most any types of food.

Even still another object of the present invention is to provide a new portable cooking apparatus that can be easily and quickly set up as a cooking apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
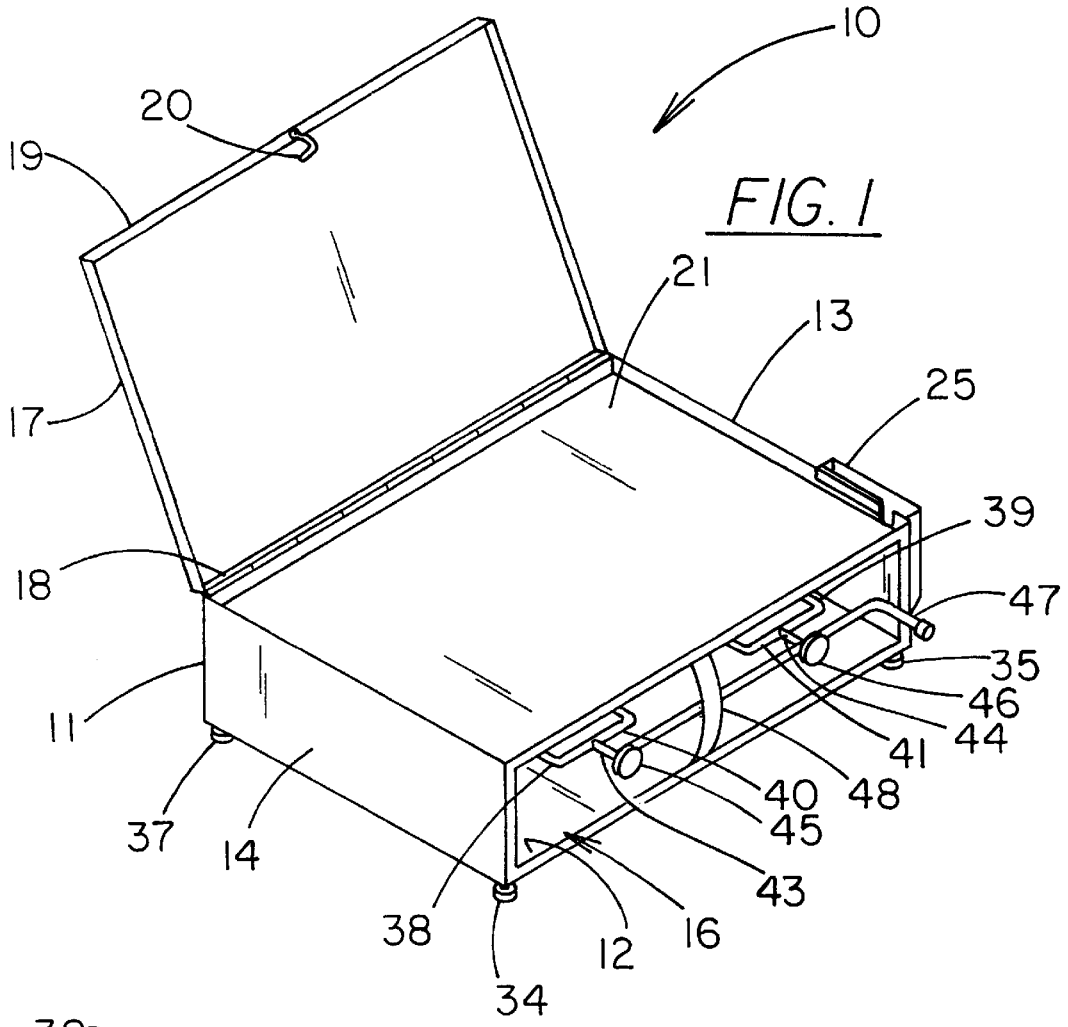
FIG. 1 is a top perspective view of a new portable cooking apparatus according to the present invention.
Figure 2:
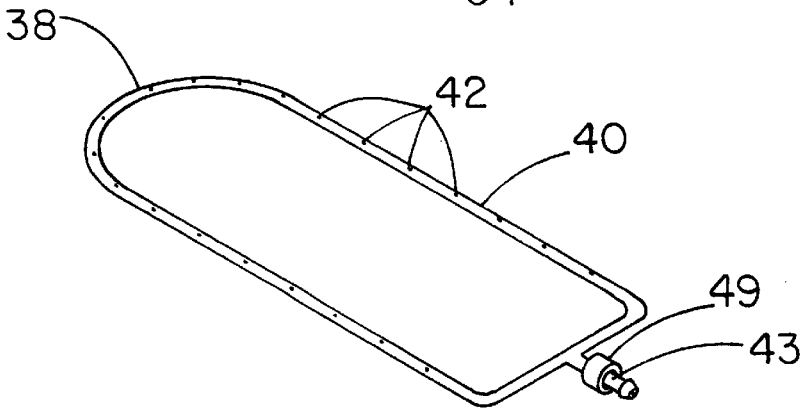
FIG. 2 is a perspective view of one of the heating elements of the present invention.
Figure 3:
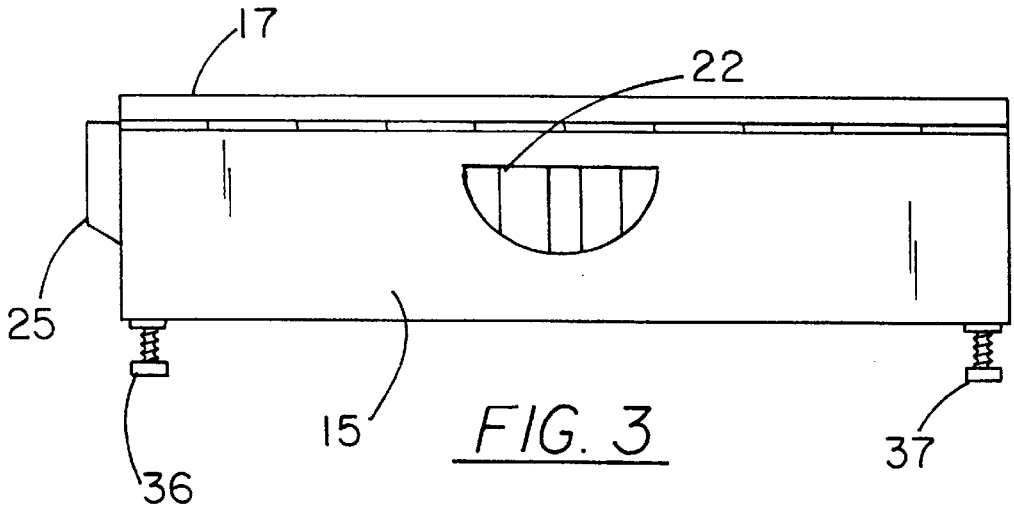
FIG. 3 is a rear elevational view of the present invention.
Figure 4:
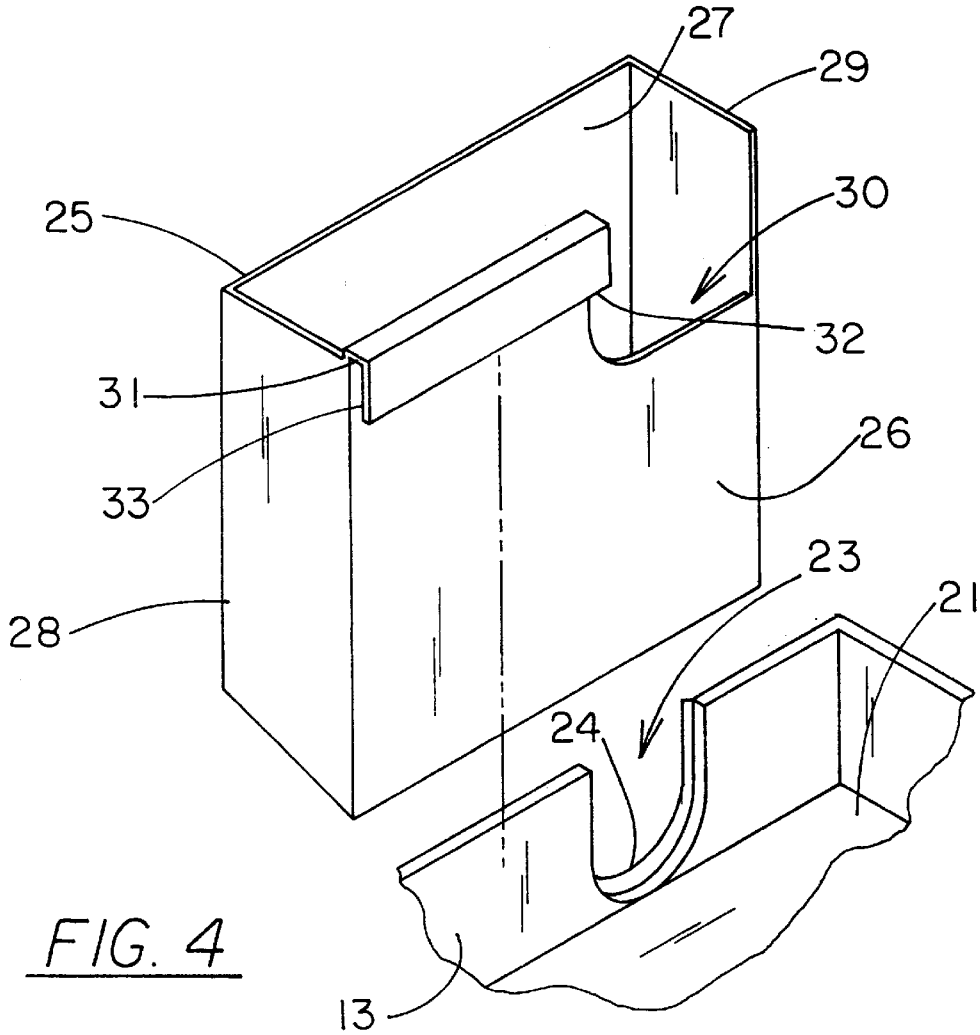
FIG. 4 is a detailed perspective view of the receptacle and first one of the side walls of the carrying case of ithe present invention.

With reference now to the drawings, and in particular to FIGS. 1 through 4 thereof, a new portable cooking apparatus embodying the principles and concepts of the present invention and generally designated by the reference numeral 10 will be described.

As best illustrated in FIGS. 1 through 4, the portable cooking apparatus 10 generally comprises a carrying case 11 having a bottom wall 12, side walls 13,14, a back wall 15, an open front 16, and a cover 17 having a back edge 18 which is hingedly attached to the back wall 15 and also having a latch member 20 securely and conventionally attached at a front edge 19 thereof for closing and securing the cover 17 upon a top of the carrying case 11. The carrying case 11 also includes a handle member 48 securely and conventionally disposed at the open front 16 and being adapted for carrying the carrying case 11. The carrying case 11 further includes an exhaust hole 22 extending through the back wall 15 thereof with the first one 13 of the side walls including an opening 23 therehrough and also including a downwardly-turned lip member 23 extending along a bottom edge of the opening 23 and integrally extending outwardly from an exterior of the first one 13 of the side walls. A griddle member 21 is securely and conventionally mounted inside the carrying case 11 with the griddle member 21 being spaced above and essentially disposed parallel to the bottom wall 12 of the carrying case 11.

A receptacle 25 is removably mounted to the first one 13 of the side walls of the carrying case 11 for receiving juices and fats from the foods being cooked upon the griddle member 21. The receptacle 25 includes a bottom wall, side walls 28,29, a back wall 26, and a front wall 27. The back wall 26 includes a slot 30 extending in a portion of a top edge thereof. The downwardly-turned lip member 24 of the first one 13 of the side walls is extendable through the slot 30 into the receptacle 25 upon the receptacle 25 being mounted to the carrying case 11. The receptacle 25 further includes a mounting bracket 31 securely and conventionally attached to and extending outwardly of the back wall 26 thereof. The mounting bracket 31 is adapted to extend over a top edge of the first one 13 of the side walls to securely support the receptacle 25 upon the carrying case 11. The mounting bracket 31 includes a first portion 32 which is securely and conventionally attached along a portion of the top edge of the back wall 26 and which extends outwardly therefrom, and also includes a second portion 33 which is angled relative to the first portion 32 and which is spaced from and disposed generally parallel to the back wall 26 of the receptacle 25.

A means for heating the griddle member 21 to temperatures capable of cooking foods thereupon includes a plurality of heating elements 38,39 securely and removably disposed inside the carrying case 11 between the bottom wall 12 of the carrying case 11 and the griddle member 21, and also includes a plurality of control valve members 45,46 conventionally mounted to the heating elements 38,39 for regulating flow of gas to the heating elements 38,39, and further includes a conduit member 47 detachably connected to the heating elements 38,39 and being adapted to be detachably connected to an energy source. Each of the heating elements 38,39 includes an endless tubular member 40,41 having a plurality of holes 42 extending therein and spaced therealong and also includes a tubular stem 43,44 extending from the tubular member 40,41 and having an end which is connectable to the conduit member 47 with a threaded sleeve-like connector 49. A plurality of adjustable leg members 34–37 are threaded in the bottom wall 12 of the carrying case 11 for supporting the carrying case 11 upon a surface when the portable cooking apparatus 10 is being used as such.

In use, the user sits the carrying case 11 upon a surface with the adjustable leg members 34–37 resting upon a surface, and then opens the cover 17 from over the top of the carrying case 11 to expose the griddle member 21 therein. Next, the user attaches an energy source such as a propane tank to the conduit member 47 and opens the control valve members 45,46 to regulate the flow of the gas to the heating elements 38,39, and the user ignites the gas passing through the heating elements 38,39 to heat the griddle member 21 to temperatures capable of cooking various foods upon the griddle member 21. When finished, the user turns off the control valve members 45,46 and disconnects the energy source from the conduit member 47 and closes and latches the cover 17 upon the carrying case 11 and uses the handle member 48 to carry the carrying case 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable cooking apparatus comprising:

a carrying case having a bottom wall, side walls, a back wall, an open front, and a cover having a back edge which is hingedly attached to said back wall and also having a latch member securely attached at a front edge thereof, and a handle member securely disposed at said open front and being adapted for carrying said carrying case;

a griddle member being securely mounted inside said carrying case;

a means for heating said griddle member to temperatures capable of cooking foods thereupon;

a receptacle being removably mounted to an outer surface of a first one of said side walls of said carrying case for receiving juices and fats from the foods being cooked upon said griddle member;

a plurality of adjustable leg members threaded in said bottom wall of said carrying case for supporting said carrying case upon a surface when said portable cooking apparatus is being used as such;

a top edge of said first one of said side walls including a notch therethrough and also including a lip member extending along a bottom edge of said notch and integrally extending outwardly from an exterior of said first one of said side walls;

said receptacle including a bottom wall, side walls, a back wall, and a front wall, said back wall including a slot extending in a top edge thereof, said lip member of said first one of said side walls being extendable into said slot into said receptacle upon said receptacle being mounted to said carrying case; and said receptacle further including a mounting bracket securely attached to and extending outwardly of said back wall thereof, said mounting bracket defining a channel adapted to receive the top edge of said first one of said side walls to securely support said receptacle upon said carrying case with said slot in communication with said notch for permitting grease flow from said griddle member through the slot and notch into said receptacle.

2. A portable cooking apparatus as described in claim 1, wherein said carrying case further includes an exhaust hole extending through said back wall thereof.

3. A portable cooking apparatus as described in claim 1, wherein said griddle member is spaced above and essentially disposed parallel to said bottom wall of said carrying case.

4. A portable cooking apparatus as described in claim 1, wherein said mounting bracket includes a first portion which is securely attached along a portion of said top edge of said back wall and which extends outwardly therefrom, and also includes a second portion which is angled relative to said first portion and which is spaced from and disposed generally parallel to said back wall of said receptacle.

5. A portable cooking apparatus as described in claim 1, wherein said means for heating said griddle member includes a plurality of heating elements securely disposed inside said carrying case between said bottom wall of said carrying case and said griddle member, and also includes a plurality of control valve members mounted to said heating elements for regulating flow of gas to said heating elements; and further includes a conduit member detachably connected to said heating elements and being adapted to be detachably connected to an energy source.

6. A portable cooking apparatus as described in claim 5, wherein each of said heating elements includes an endless tubular member having a plurality of holes extending therein and spaced therealong and also includes a tubular stem extending from said tubular member and having an end which is connectable to said conduit member with a threaded sleeve-like connector.

7. A portable cooking apparatus comprising:

a carrying case having a bottom wall, side walls, a back wall, an open front, and a cover having a back edge which is hingedly attached to said back wall and also having a latch member securely attached at a front edge thereof, and a handle member securely disposed at said open front and being adapted for carrying said carrying case, said carrying case further including an exhaust hole extending through said back wall thereof, said first one of said side walls including an opening therethrough and also including a downwardly-turned lip member extending along a bottom edge of said opening and integrally extending outwardly from an exterior of said first one of said side walls;

a griddle member being securely mounted inside said carrying case, said griddle member being spaced above and essentially disposed parallel to said bottom wall of said carrying case;

a receptacle being removably mounted to an outer surface of a first one of said side walls of said carrying case for receiving juices and fats from the foods being cooked upon said griddle member, said receptacle including a bottom wall, side walls, a back wall, and a front wall, said back wall including a slot extending in a top edge thereof, said downwardly-turned lip member of said first one of said side walls being extendable through said slot into said receptacle upon said receptacle being mounted to said carrying case, said receptacle further including a mounting bracket securely attached to and extending outwardly of said back wall thereof, said mounting bracket being adapted to extend over a top edge of said first one of said side walls to securely support said receptacle upon said carrying case, said mounting bracket including a first portion which is securely attached along a portion of said top edge of said back wall and which extends outwardly therefrom, and also including a second portion which is angled relative to said first portion and which is spaced from and disposed generally parallel to said back wall of said receptacle;

a means for heating said griddle member to temperatures capable of cooking foods thereupon including a plurality of heating elements securely disposed inside said carrying case between said bottom wall of said carrying case and said griddle member, and also including a plurality of control valve members mounted to said heating elements for regulating flow of gas to said heating elements; and further including a conduit member detachably connected to said heating elements and being adapted to be detachably connected to an energy source, each of said heating elements including an endless tubular member having a plurality of holes extending therein and spaced therealong and also including a tubular stem extending from said tubular member and having an end which is connectable to said conduit member with a threaded sleeve-like connector; and a plurality of adjustable leg members threaded in said bottom wall of said carrying case for supporting said carrying case upon a surface when said portable cooking apparatus is being used as such.

8. The cooking apparatus of claim 1, wherein the griddle member comprises a first surface, said first surface being uniformly smooth.

* * * * *